US005501271A

United States Patent [19]

Wijkstrom

[11] Patent Number: 5,501,271

[45] Date of Patent: Mar. 26, 1996

[54] HEAT-EXCHANGER TANK

[75] Inventor: Björn Wijkstrom, Asarum, Sweden

[73] Assignee: Valeo Engine Cooling AB, Solvesborg, Sweden

[21] Appl. No.: 420,360

[22] Filed: Apr. 11, 1995

[30] Foreign Application Priority Data

Apr. 11, 1994 [SE] Sweden ..... 9401212

[51] Int. Cl.[6] ..... F28F 9/02

[52] U.S. Cl. ..... 165/173; 165/151; 165/153; 165/175

[58] Field of Search ..... 165/151, 153, 165/173, 175

[56] References Cited

U.S. PATENT DOCUMENTS

| | | | |
|---|---|---|---|
| 2,899,177 | 8/1959 | Harris et al. | 166/153 |
| 3,415,315 | 12/1968 | Donaldson et al. | 165/148 |
| 3,703,925 | 11/1972 | Ireland et al. | 165/151 |
| 4,187,090 | 2/1980 | Bizzarro et al. | 165/174 X |
| 4,938,284 | 7/1990 | Howells | 165/153 X |
| 5,127,466 | 7/1992 | Ando | 165/153 X |
| 5,251,694 | 10/1993 | Chigira | 165/173 |

FOREIGN PATENT DOCUMENTS

| | | | |
|---|---|---|---|
| 4130517 | 3/1993 | Germany . | |
| 333939 | 7/1968 | Sweden . | |
| 699032 | 10/1953 | United Kingdom | 165/173 |
| 860359 | 2/1961 | United Kingdom | 165/175 |
| 904498 | 8/1962 | United Kingdom | 165/148 |
| 2098313 | 11/1982 | United Kingdom | 165/149 |
| 2196730 | 5/1988 | United Kingdom . | |

*Primary Examiner*—Leonard R. Leo
*Attorney, Agent, or Firm*—Morgan & Finnegan

[57] ABSTRACT

A heat-exchanger tank consisting of a cover and a plate (5) fixed at the opening of the cover, the plate (5) being elongate and U-shaped, having a web portion (20) and two flanges (21, 22); and the cover consisting of a U-shaped middle piece (2) fixed with its flanges (18, 19) to the plate flanges, and two separately manufactured cup-shaped end pieces (3, 4), the mouths of which are U-shaped for connection to the respective end of the middle piece (2); and the end piece (3, 4) having two guide flanges (12, 13) connected to the flanges (21, 22) of the plate and arranged so as, when the heat-exchanger tank is mounted, to guide the end pieces (3, 4) into correct alignment with the middle piece (2).

11 Claims, 2 Drawing Sheets

HEAT-EXCHANGER TANK

FIELD OF THE INVENTION

The invention relates to a heat-exchanger tank and a heat-exchanger and, more specifically but not exclusively to a heat-exchanger tank and a heat-exchanger comprising a heat-exchanger tank consisting of a cover, the cover having an opening and a plate, the plate being fixed at the opening of the cover.

BACKGROUND OF THE INVENTION

Heat exchangers are used, inter alia, in motor vehicles, in the form of a vehicle cooler. Modern vehicle coolers are used in all types of vehicle, from small passenger cars to large long-distance trucks. The vehicle cooler must therefore be adapted to each individual model and variants thereof, based upon the size and performance of the vehicle. The need for different types of vehicle cooler and a specific vehicle cooler of different size is therefore very great.

A conventional vehicle cooler has one or two cooler tanks and a heat-exchanger assembly disposed between them. The heat-exchanger assembly normally consists of rows of pipes and surface extenders situated therebetween; whilst the cooler tank consists of a trough-shaped cover and an end plate, of which the latter is connected to the pipes in the heat-exchanger assembly.

The conventional vehicle cooler can be entirely designed in copper-brass, i.e. both the tank or tanks and the heat-exchanger assembly, or can also have a heat-exchanger assembly in aluminum and a tank having a cover formed in plastic and an end plate formed in an aluminum alloy.

The heat-exchanger assembly of the vehicle cooler is easy to vary in size, since it consists of individual pipes arranged in rows and surface extenders which, broadly speaking, are made to meter-length specification. The two component parts forming the cooler tank are each produced in one piece, however, by deep-drawing of the cover and the end plate in the case of a pure copper-brass cooler, and by injection-molding of the plastic cover and deep-drawing of the aluminum end plate in the case of an aluminum/plastic cooler. For the production of these component parts, regardless of whether carried out by deep-drawing or injection-molding, specific tools are required for each individual cooler tank dimension. This can be seen to constitute a problem, since the cost of production of each tool is considerable.

It is also therefore recognized that there is a need for a solution which is better in relation to known methods, and especially where the production runs for a specific vehicle cooler dimension are small.

The object of the present invention is therefore to realize a heat-exchanger tank which is simple to adapt to heat exchangers of different dimensions.

SUMMARY OF THE INVENTION

The object of the invention is achieved by means of a heat-exchanger tank consisting of a cover, the cover having an opening and a plate, the plate being fixed at the opening of the cover, the plate being elongate and U-shaped, and having a web portion and two flanges, the cover consisting of a U-shaped middle piece and two separately manufactured cup-shaped end pieces, said middle piece having flanges, the flanges being secured to the plate flanges, said end pieces defining mouths, said mouths being U-shaped for connection to a respective end of the middle piece each end piece further having two guide flanges, said guide flanges being connectable to the flanges of the plate and being adapted to guide the end pieces into correct alignment with the middle piece when the heat-exchanger tank is being assembled, and a heat exchanger comprising such a heat-exchanger tank.

BRIEF DESCRIPTION OF THE DRAWINGS

Two preferred embodiments of the invention shall now be described, for illustrative purposes, with reference to the appended drawings, in which.

DESCRIPTION OF THE PREFERRED EMBODIMENT

Figure 1:
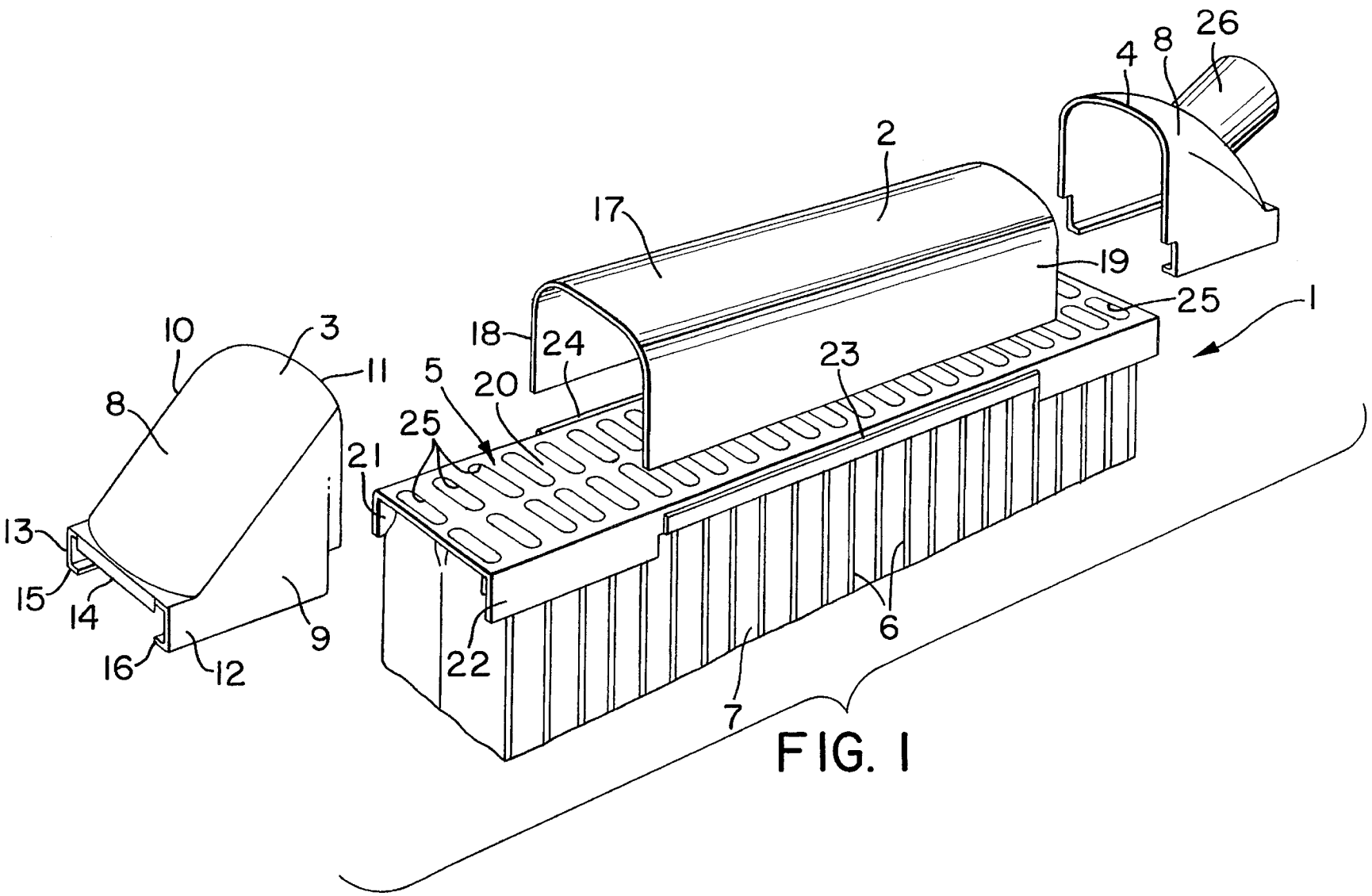
FIG. 1 is an exploded view of an upper part of a vehicle cooler exhibiting a heat-exchanger tank according to a first embodiment of the invention.

FIG. 1 shows an upper portion of a vehicle cooler having a tank according to a first embodiment of the invention, which tank is generally denoted by 1. The vehicle cooler is made from an aluminum alloy. The tank 1 consists of a U-shaped middle piece 2, two end pieces 3, 4 and an end plate 5, which is connected to pipes 6 belonging to a heat-exchanger assembly 7. The end piece 3 is cup-shaped and has a downward-sloping wall 8, two slightly rounded side walls 9, 10 and a U-shaped connecting flange 11, which forms the mouth of the end piece 3. The end piece 3 is further provided with two guide flanges 12, 13, which extend along the sides and downwards from the side walls, and a fixing tongue 14, which extends downwards from the rear end of the end piece 3, i.e. oppositely to the mouth. Extending in the direction essentially perpendicularly inwards from the respective guide flange 12, 13 there are fixing lips 15, 16.

Figure 2:
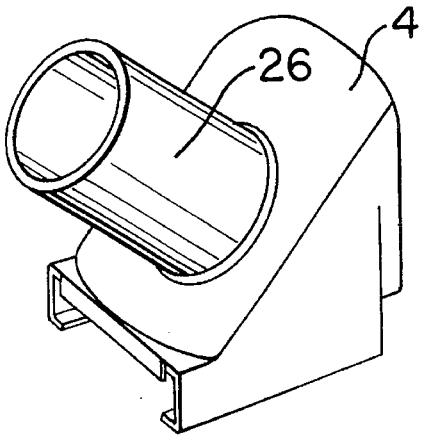
FIG. 2 is a perspective view of an end piece forming part of the heat-exchanger tank according to the invention.

The second end piece 4, which is clearly apparent from FIG. 2, is identical to the first end piece 3, with the exception of a pipe socket 26 connected to the top wall 8 of the end piece 4.

The middle piece 2 consists of a U-shape bent sheet, having a web 17 and two flanges 18, 19.

The end plate 5 also consists of a U-shape bent sheet, having a web 20 and two flanges 21, 22, which however, approximately half-way across the width, are bent outwards and upwards to form a groove 23, 24. The length of the groove 23, 24 corresponds to the length of the middle piece 2. Openings 25 are further incorporated in the web 20 of the end plate 5 for reception of the pipes 6 in the heat-exchanger assembly 7.

All parts belonging to the vehicle cooler tank are preferably formed in an aluminum alloy to enable them to be joined together by hard-soldering.

The flanges 18, 19 of the middle piece, the flanges 21, 22 of the end plate and the guide flanges 12, 13 of the end pieces are all slightly conical, ca. 1°, for simplified fitting-together. The assembly of the cooler tank is effected as follows.

The middle piece is placed on top of the end plate 5 such that its flange edges are received in the grooves 23, 24. The lower portions of the flanges of the middle piece are brought to lie tight against the inner walls of the respective groove, i.e. the non-bent-up part of the flange 21, 22 of the end plate. This is realized by the inner distance between the flanges 18, 19 of the middle piece being equal to the web 20 of the end plate, the flanges of the middle piece being forced somewhat apart to enable them to be placed in the grooves.

The end pieces are then slid on from the ends of the end plate 5, so that their guide flanges 12, 13 lie tight against the flanges 21, 22 of the end plate 5 and their tongue 14 bears against that edge of the web 20 which is situated against the end piece. The connecting flange 11 is of a dimension which enables the edge of the U-shaped middle piece to be connected up and the latter to be pressed down against the end plate 5. The connecting flange therefore overlaps the middle piece in a grip fitting. This latter is clearly apparent from FIG. 3.

Figure 3:
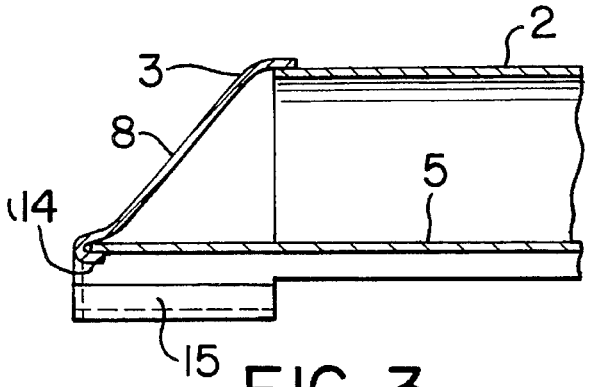
FIG. 3 is a longitudinal section view of the tank of FIG. 1.

From FIG. 3 it can also be seen that the end pieces 3, 4 are fixed in the horizontal and vertical positions by the tongue 14 being folded in under the web 20 of the end plate and by the guide lips 15, 16 being bent around the flanges of the end plate 5.

Fixation of the middle piece in the vertical direction is realized, moreover, by the connecting flange being pressed down over the web of the middle piece, see FIG. 3, and by clamping of the groove for contact-bearing against that portion of the flanges of the central portion which is situated in the respective groove.

Joining-together of the parts belonging to the cooler tank is realized by hard-soldering in a vacuum furnace. A thin surface coating of the respective component part melts and forms solder material, the parts being connected along the mutually overlapping portions of the parts. Here it is desirable if the overlapping portions lie tight against one another in order to obtain a better soldering result. A small air gap can be allowed, but it must not then exceed 0.1 mm.

Figure 4:
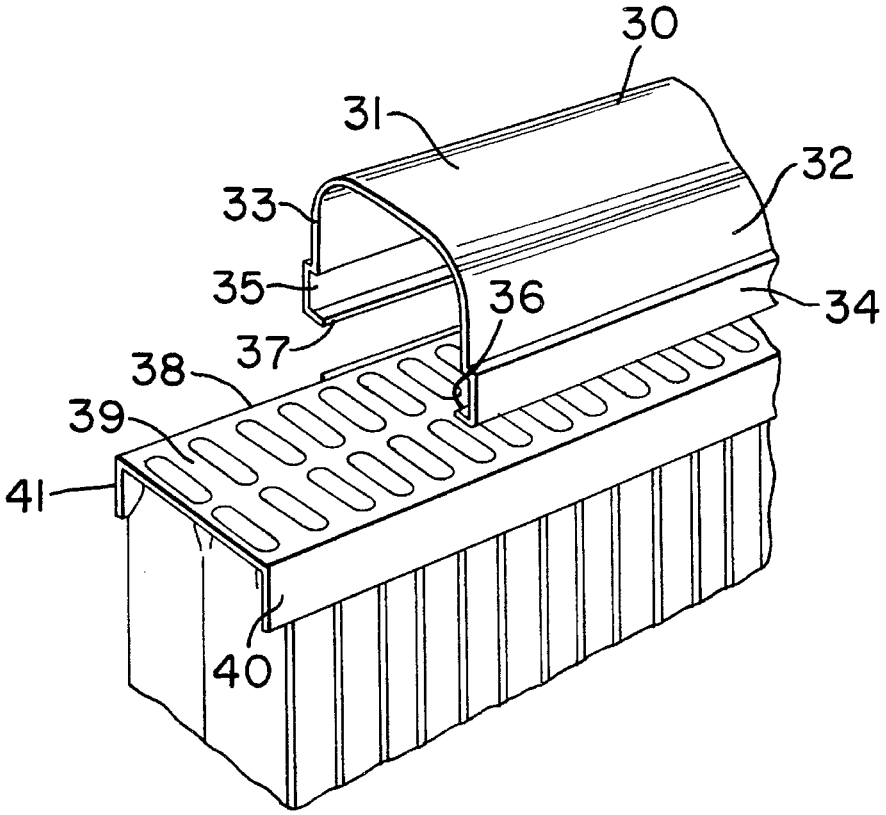
FIG. 4 is an exploded view of pare of a heat-exchanger tank according to a second embodiment of the invention.

FIG. 4 shows a second preferred embodiment of a heat-exchanger tank according to the invention which utilizes the end pieces 3, 4, these being identical to those described in the preceding embodiments so that they are omitted from the figure.

The cooler tank also comprises a middle piece 30, which is U-shaped and has a web 31 and two flanges 32, 33. The flanges 32, 33, unlike the first-described embodiment, have guide flanges 34, 35. Similar to the guide flanges 12, 13 of the end pieces 3, 4, the guide flanges 34, 35 of the middle section have an in-bent fixing lip 36, 37.

The cooler tank further has an end plate 38, which is bent in a U-shape and therefore has a web 39, forming the base of the tank, and two flanges 40, 41.

The assembly of the middle piece on top of the end plate is realized either by the flanges 32, 33 of the middle piece being forced outwards apart to the point where the guide flanges 34, 35 of the flanges 32, 33 can be snapped in place over the flanges 40, 41 of the end plate 38 so that the guide flanges 34, 35 bear tightly against the flanges 40, 41, or by the middle piece 30 being slid on from the end of the end plate 38 with the guide flanges situated outside the end plate 30 in bearing-contact against its flanges, i.e. in the same way as the end pieces 3, 4 in the preceding embodiment.

After this, the fixing lips 36, 37 are folded or bent upwards and inwards to the point where they are bearing against the respective inner side of the flanges 40, 41 of the end plate 38. The end pieces 3, 4 are then slid on in the same way as in the first-described embodiment, after which hard-soldering of the entire tank assembly is carried out in a vacuum furnace.

By virtue of the invention, a large number of advantages are attained over known methods. The splitting of the cover of the vehicle cooler tank into a middle piece and two end pieces enables middle pieces to be made to meter-length specification, i.e. they can be manufactured in large lengths and then cut to a length suitable for a specific cooler. The end pieces can also be made in standard construction for different longitudinal dimensions of the vehicle cooler. A tool can thereby be produced for deep-drawing of the end pieces, whilst the tool is totally eliminated in the production of the middle piece, since this is bent or rolled from a flat tube blank. The U-shaped profile of the end plate also allows it to be made to meter-length specification, followed by cutting to a desired length, and the flanges to be possibly bent over to form a groove, i.e. according to the first-described preferred embodiment. The end plate is also produced by bending or rolling, thereby allowing expensive tools to be eliminated.

By virtue of the design of the middle piece and of the end plate and the standard construction of the end pieces, the cooler tank is entirely adaptable in its length, which is wholly determined by the necessary length of the vehicle cooler.

The design of the parts and their joining-together is also such that the parts are fixed together in such a way that the need for special fixtures in a subsequent hard-soldering procedure is eliminated.

It is recognized, however, that the invention can be modified in a large number of ways within the scope of that which is expressed in the patent claims. Even though the cooler tanks shown in the two preferred embodiments are designed in aluminum and their parts, in assembly, are hard-soldered together, it is fully possible with the same inventive concept to produce a tank in another material, such as stainless steel or plastic. In assembling a correspondingly designed plastic tank, a different joining method would obviously have to be used, such as gluing, for example.

What I claim is:

1. A heat-exchanger tank consisting of a cover, the cover having an opening and a plate, the plate being fixed at the opening of the cover, the plate being elongate and U-shaped, and having a web portion and two flanges, the cover consisting of a U-shaped middle piece and two separately manufactured cup-shaped end pieces, said middle piece having flanges, the flanges being secured to the plate flanges, said end pieces defining mouths, said mouths being U-shaped for connection to a respective end of the middle piece, each end piece further having two guide flanges, said guide flanges being connectable to the flanges of the plate and being adapted to guide the end pieces into correct alignment with the middle piece when the heat-exchanger tank is being assembled, wherein each end piece further having a fixing tongue at an end opposite to said mouth and being bent around an end edge of the plate.

2. The heat-exchanger tank of claim 1, wherein the guide flanges have fixing lips, and the fixing lips are adapted to be folded around an adjacent edge of the plate for fixation of the end piece thereto.

3. The heat-exchanger tank of claim 1, wherein the flanges of the plate are outwardly folded over a distance corresponding to the length of the middle piece to form grooves, in which the middle piece is to be fixed.

4. The heat-exchanger tank of claim 1, wherein the flanges of the middle piece have guide flanges which are fixed to the flanges of the plate and adapted to guide the middle piece into correct alignment with the plate.

5. The heat-exchanger tank of claim 4, wherein the guide flanges of the middle piece have a fixing lip adapted to be folded around the adjacent edge of the plate flange for fixation of the middle piece to the plate.

6. The heat exchanger having a heat-exchanger assembly and at least one heat-exchanger tank according to claim 1.

7. A heat-exchanger tank consisting of a cover, the cover having an opening and a plate, the plate being fixed at the opening of the cover, the plate being elongate and U-shaped, and having a web portion and two flanges) the cover consisting of a U-shaped middle piece and two separately manufactured cup-shaped end pieces, said middle piece having flanges, the flanges being secured to the plate flanges, said end pieces defining mouths, said mouths being U-shaped for connection to a respective end of the middle piece, each end piece further having two guide flanges, said guide flanges being connectable to the flanges of the plate and being adapted to guide the end pieces into correct alignment with the middle piece when the heat-exchanger tank is being assembled, the guide flanges having fixing lips, the fixing lips being adapted to be folded around an adjacent edge of the plate for fixation of the end piece thereto.

8. The heat-exchanger tank of claim 7, wherein the flanges of the plate are outwardly folded over a distance corresponding to the length of the middle piece to form grooves, in which the middle piece is to be fixed.

9. The heat-exchanger tank of claim 7, wherein the flanges of the middle piece have guide flanges which are fixed to the flanges of the plate and adapted to guide the middle piece into correct alignment with the plate.

10. The heat-exchanger tank of claim 9, wherein the guide flanges of the middle piece have a fixing lip adapted to be folded around the adjacent edge of the plate flange for fixation of the middle piece to the plate.

11. The heat-exchanger having a heat-exchanger assembly and at least one heat-exchanger tank according to claim 7.

* * * * *

UNITED STATES PATENT AND TRADEMARK OFFICE

CERTIFICATE OF CORRECTION

PATENT NO. : 5,501,271

DATED : March 26, 1996

INVENTOR(S) : Björn Wijkstrom

It is certified that error appears in the above-indentified patent and that said Letters Patent is hereby corrected as shown below:

At Column 5, line 10 after flanges delete " ) " and insert " , ".

Signed and Sealed this

First Day of October, 1996

*Attest:*

Bruce Lehman

BRUCE LEHMAN

*Attesting Officer*

*Commissioner of Patents and Trademarks*